United States Patent [19]

Pridy

[11] Patent Number: 4,538,438

[45] Date of Patent: Sep. 3, 1985

[54] WATER CONSERVING ELONGATE TUBULAR METAL MEMBER STRAIGHTENING APPARATUS

[76] Inventor: Whestine B. Pridy, 2757 Cherry Ave., Long Beach, Calif. 90806

[21] Appl. No.: 626,928

[22] Filed: Jul. 2, 1984

[51] Int. Cl.[3] ..... B21C 3/10; B21C 43/00

[52] U.S. Cl. ..... 72/39; 29/81 F; 72/40; 72/389

[58] Field of Search ..... 72/39, 40, 389; 29/81 R, 81 A, 81 B, 81 F, 81 G, 81 J

[56] References Cited

U.S. PATENT DOCUMENTS

| | | | |
|---|---|---|---|
| 1,879,009 | 9/1932 | Anthony | 29/81 F |
| 2,996,789 | 8/1961 | Pridy | 29/81 A |
| 3,446,054 | 5/1969 | Pridy | 72/389 |
| 4,131,005 | 12/1978 | Pridy | 72/40 |
| 4,165,626 | 8/1979 | Pridy | 72/40 |

*Primary Examiner*—E. Michael Combs
*Attorney, Agent, or Firm*—William C. Babcock

[57] ABSTRACT

A portable tubular metal member straightening apparatus that complies with ecological standards by retaining all foreign solid material displaced from an elongate member as the latter is straightened, recirculates the cooling and wash water rather than spilling it on the ground, and includes a rearward frame extension portion that may be pivoted to an upwardly and forwardly extending position prior to the apparatus being moved over a public highway to bring the apparatus within the length limits imposed on the highway.

5 Claims, 8 Drawing Figures

WATER CONSERVING ELONGATE TUBULAR METAL MEMBER STRAIGHTENING APPARATUS

DESCRIPTION OF THE PRIOR ART

In my previous U.S. Pat. No. 4,165,626 that issued Aug. 28, 1979 entitled "Wash Water Supplying Drive Head and Scraper and Cutter Assembly" as well as my U.S. Pat. No. 3,446,054 that issued May 27, 1969 entitled "Apparatus for Straightening Elongate Metal Members" I disclosed and claimed devices for use in straightening elongate tubular member, removing foreign solid material therefrom, and hydraulically testing the tubular members after they have been straightened and cleaned.

When my prior inventions were used cooling and wash water was allowed to discharge onto the grounds as were cuttings and foreign material removed from the elongate members during the straightening operation. Such discharge of cooling water and foreign material onto the ground is no longer allowed due to violating ecological standards now in force.

A major object of the present invention is to provide an apparatus that is portable and may be adjusted to an overall length that permits it to be moved over a public highway, as well as one that permits an elongate tubular member to be straightened without violating ecological standards, due to the cooling and wash water being conserved by recirculating it within the apparatus, and all cuttings and foreign material displaced from the elongate members being straightened being recovered and retained within the present invention.

SUMMARY OF THE INVENTION

An elongate tubular member straightening apparatus that includes a forward portion and a cantilevered rearward portion pivotally supported from the forward portion. When the rearward portion is longitudinally aligned with the forward portion a pan and pan extension are defined that are sealingly joined to provide a confined space into which cooling and wash water and foreign material discharge from a tubular member situated thereabove as the tubular member is straightened. The cooling and wash water is conserved by being recirculated as the straightening operation proceeds. Foreign material displaced from the tubular member as it is straightened is retained within the confined space. When the invention is not in use the rearward portion may be pivoted to an upwardly and forwardly extending position to bring the overall length of the apparatus within the vehicle length limits imposed on public highways.

DESCRIPTION OF THE PREFERRED EMBODIMENT

The apparatus A of the present invention includes a vehicle B that is adapted to have a tubular member D, such as drill pipe, upset oil well tubing or the like, removably disposed in a longitudinal combined position thereon. The tubular member D when so disposed is rotated by a driving mechanism E situated at the forward end of the vehicle. A carriage F is longitudinally movable on the vehicle B, with the carriage F supporting a hydraulic assembly G that includes an upwardly disposed pressure pad H and a pair of lower longitudinally spaced pressure pads H-1, as may be seen in FIG. 1, and that at least partially support the tubular member D.

A first endless chain link belt L is rotatably supported in a longitudinal position on the vehicle B, with the belt having the carriage F secured thereto. When the first belt L is driven as will later be explained the carriage F is moved longitudinally on the vehicle B.

During the rearward movement of the carriage F on the vehicle B the hydraulic assembly G is actuated to sequentially transversely deform sections of the tubular member D as the latter rotates to not only straighten the tubular member but to fracture solid deposited foreign material within the interior thereof. The pressure pad H during the straightening operation is in frictional contact with the rotating tubular member D and the latter is heated as a result thereof. Such heat is detrimental to the metal defining the tubular metal D and is substantially eliminated by discharging a stream of cooling water from the driving mechanism E rearwardly through the tubular member.

Until recently such cooling water and foreign solid material removed from the tubular member being straightened was allowed to discharge onto the ground. However, due to ecological requirements now in force, such discharge is no longer permitted. The present invention A when used for straightening tubular members complies with such ecological requirements by recirculating the cooling water and directing all foreign material removed from the tubular member during the straightening operation to a confined space for subsequent disposal.

Figure 1:
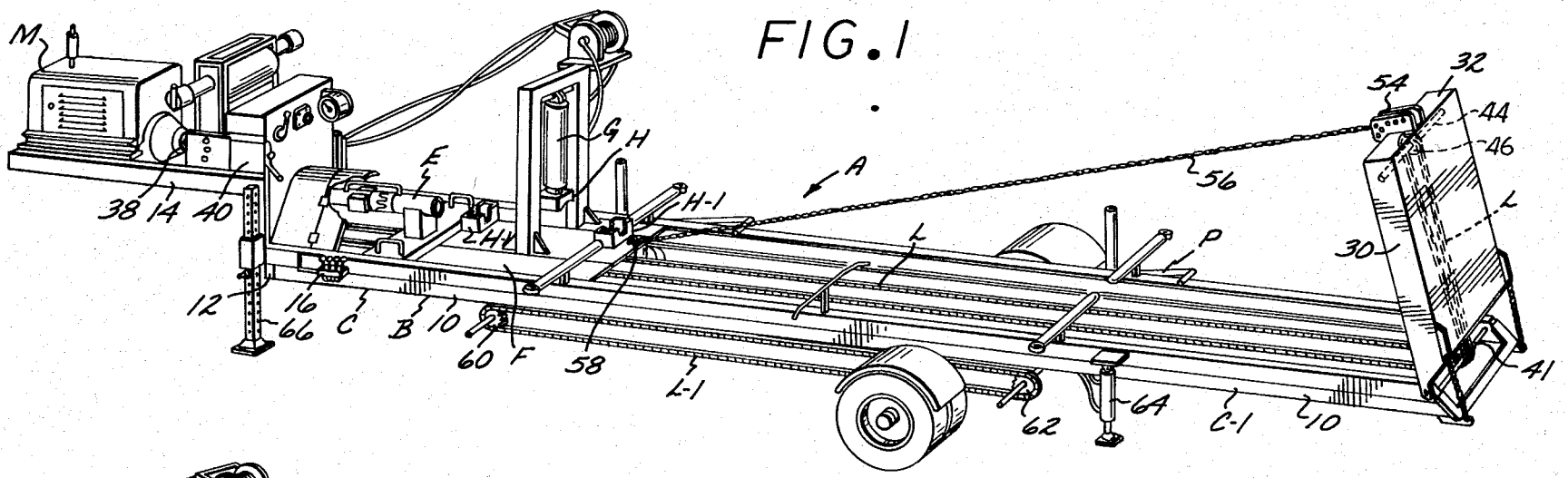
FIG. 1 is a perspective view of the invention with the rearward portion thereof pivoted to an upward and forwardly extending position to bring the overall length of the invention within the vehicle length limit imposed on a particular public highway.
Figure 2:
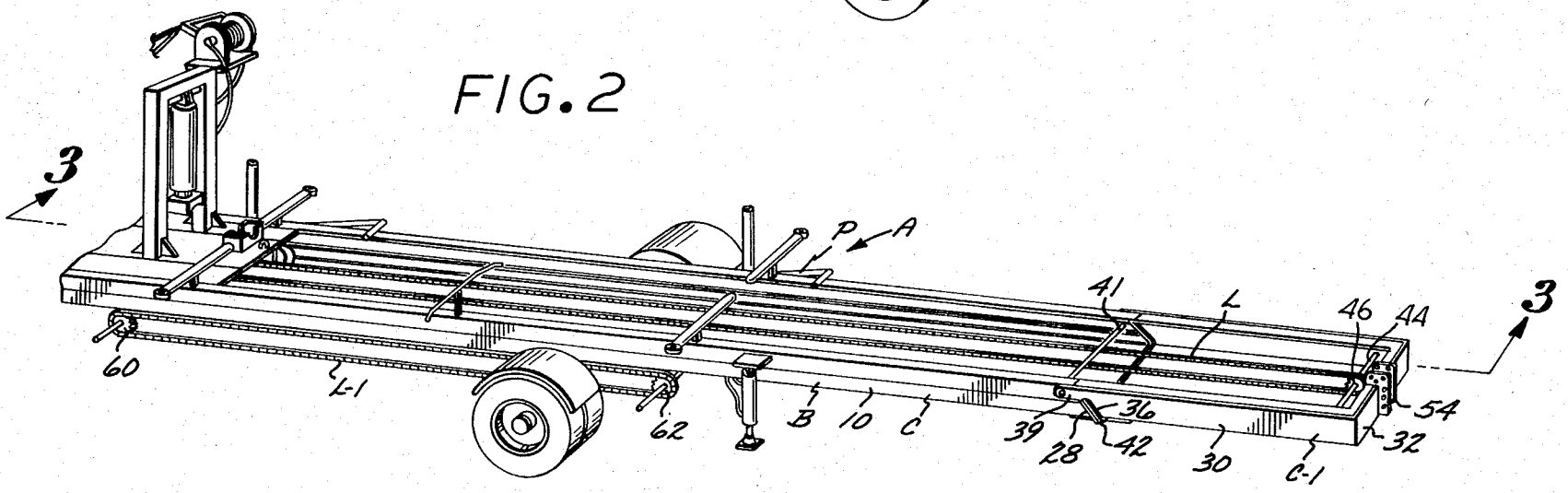
FIG. 2 is a perspective view of the invention in a tubular member straightening position.
Figure 3:
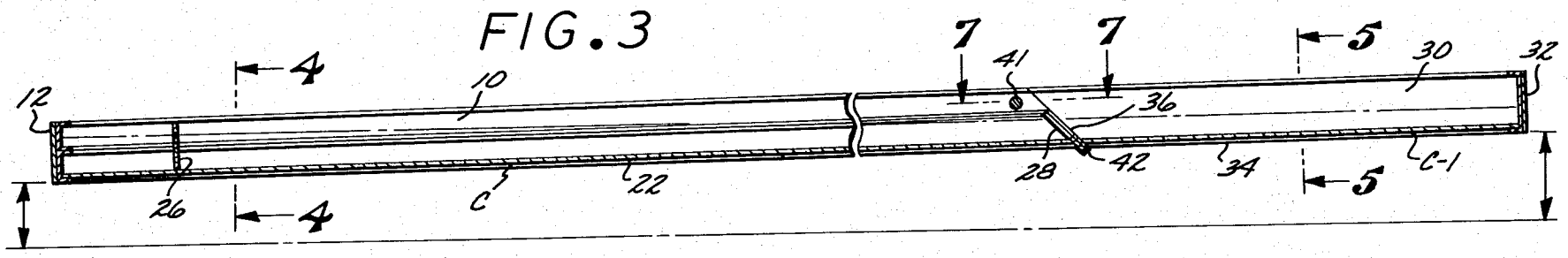
FIG. 3 is a longitudinal cross sectional view of the invention taken on the line 3—3 of FIG. 2.
Figure 5:
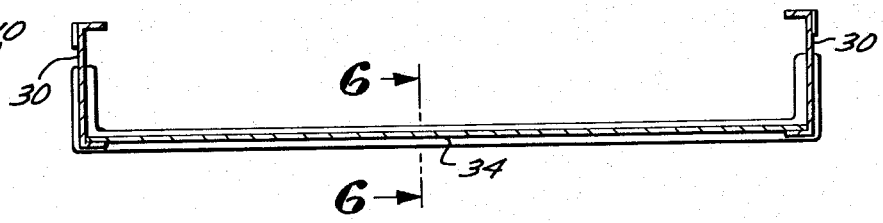
FIG. 5 is a second transverse cross sectional view of the invention taken on the line 5—5 of FIG. 3.
Figure 4:
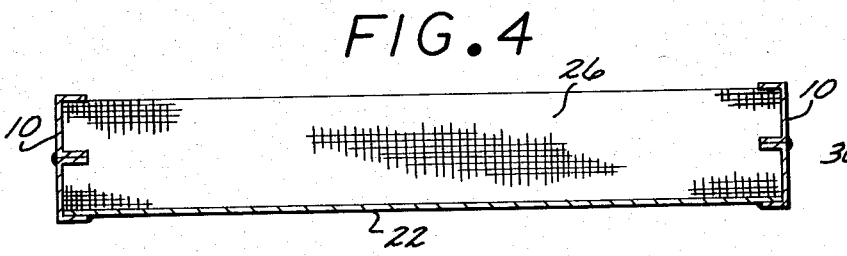
FIG. 4 is a transverse cross sectional view of the invention taken on the line 4—4 of FIG. 3.
Figure 7:
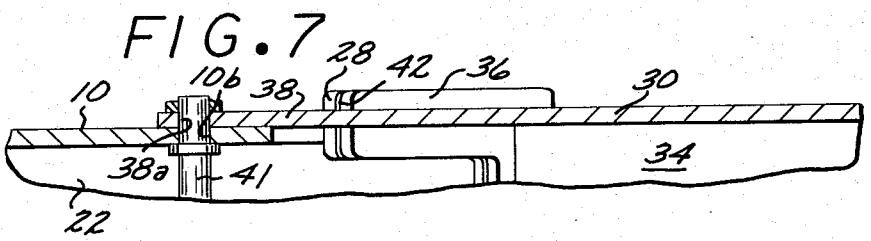
FIG. 7 is a fragmentary top plan view of the invention taken on the line 7—7 of FIG. 3.
Figure 6:
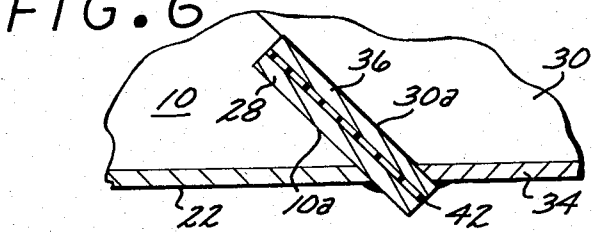
FIG. 6 is a fragmentary cross sectional view of the invention taken on the line 6—6 of FIG. 5.

In FIG. 1 it will be seen that the vehicle B includes an elongate frame C and a frame extension C-1 pivotally supported therefrom. When the apparatus A is not in use the frame extension C-1 is pivoted to the upward and forwardly extending position shown in FIG. 1. The lengths of the frame C and frame extension C-1 may be such that when longitudinally aligned as shown in FIG. 2 the overall length exceeds that of the legal limit for moving a vehicle over a public highway, but the invention being placed within the legal limit by pivoting the frame extension to the upward and forwardly extending position shown in FIG. 1.

The frame C includes a pair of elongate, laterally spaced, parallel side pieces 10 that on their forward ends are connected by a cross piece 12, with the side pieces having downwardly and rearwardly tapering edges 10*a*. An upset platform 14 is secured to the forward end of frame C as shown in FIG. 1, which platform supports an engine M that has a drive shaft 38 connected to a transmission 40. The transmission 40 rotates the driving mechanism E, the belt L, a second belt L-1, and a pump 15 by conventional means (not shown) that are selectively actuated by manually operated control means 16. The above identified portion of the invention is the same as shown and described in my previous U.S. Pat. No. 4,165,626 that issued Aug. 28, 1979 entitled "Wash Water Supplying Drive Head and Scraper and Cutter Assembly".

The forward cross piece 12 and the pair of side pieces 10 have a sheet 22 of a rigid material secured thereto. The sheet 22 at the forward portion thereof has a wash water drain opening formed therein. A screen 26 extends transversely between the side pieces 10 rearwardly of wash water drain opening 24 to prevent solid material displaced from the tubular member D entering the drain opening. The rear edges 10*a* of the pair of cross pieces and rear edge of sheet 22 have a forward generally U-shaped member 28 welded or otherwise secured thereto.

The frame extension C-1 is defined by a pair of parallel laterally spaced second side pieces 30 that are connected by a rearward cross piece 32, and the lower surfaces of the pair of second cross pieces and rearward cross piece having a second sheet 34 secured thereto. The forward edges 30*a* of the pair of second side pieces taper downwardly and rearwardly at substantially the same angles as the rear edges 10. A second U-shaped transverse member 36 is secured to the forward edges of the pair of second side pieces.

The pair of second side pieces 30 have a pair of legs 38 extending forwardly therefrom in which transversely aligned openings 38*a* are formed that pivotally engage a transverse shaft 41 that extends through opening 10*b* in the rearward portion of the pair of first side pieces 10. A resilient U-shaped pad 42 is secured to either the U-shaped member 28 or U-shaped member 36.

When the frame extension C-1 is pivoted to the cantilevered position shown in FIG. 2, the weight of the frame extension will tend to pivot it downwardly, and the resilient pad 40 being compressed into sealing contact with the U-shaped members 28 and 36. The frame C and frame extension C-1 when the latter is disposed as shown in FIG. 2 cooperate to define an elongate pan into which wash water from the tubular member straightening operation discharges to flow forwardly to the drain opening.

Figure 8:
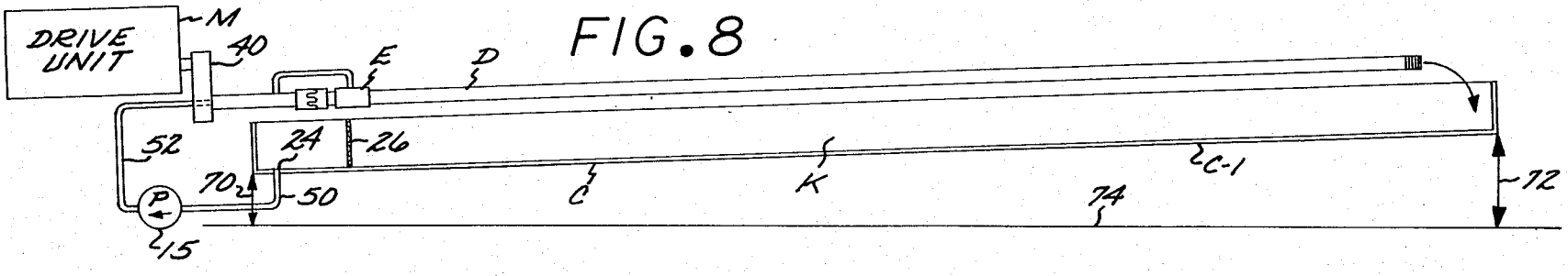
FIG. 8 is a diagramatic view of the invention.

A second transverse shaft 44 is provided on the rearward part of frame extension C-1 that supports a sprocket 46 that is engaged by the belt L, with the belt engaging a forward driving sprocket (not shown). The transmission 40 selectively actuates the driving mechanism E as disclosed in my previously issued U.S. Pat. No. 4,165,626 as well as a pump 15 that has the suction inlet connected to the drain opening by a pipe 50 as shown in FIG. 8. The discharge opening of pump 15 is connected by a pipe 52 to the driving mechanism E. Wash water discharged from the tubular member D as the latter is straightened by longitudinal movement of carriage F as also disclosed in my previously identified patent flows forwardly in the pan K defined by the frame C and frame extension C-1 to the drain opening, and then by pump 15 being recirculated to the driving mechanism E. Solid material (not shown) displaced from tubular member D as the latter is straightened, is prevented from moving into the drain opening due to screen 26.

The rearward cross piece 32 has a bracket 54 secured thereto. A cable 56 is removably secured to bracket 54 as shown in FIG. 1, which cable may be extended forwardly. A conventional attachment 58 is affixed to the cable 56 that permits the cable to be removably secured to carriage F.

After a tubular member straightening operation is completed, the cable 56 is secured to bracket 54 and carriage F, with the carriage then being moved forwardly to pivot the frame extension C-1 from the position shown in FIG. 2 to that illustrated in FIG. 1. As the above described pivoting operation takes place, the rearward portion of belt L is maintained adjacent frame extension C-1 due to the belt contacting the first shaft 41.

The transmission 40 may also be caused to selectively drive a second chain link belt L-1 supported on forward and rearward sprockets 60 and 62 to actuate a tubular member loading mechanism designated generally by the letter P in FIGS. 1 and 2, which mechanism is described in detail in my previous U.S. Pat. No. 3,446,054 and is entitled "Apparatus for Straightening Elongate Metal Members".

The frame C also has a pair of jacks 64 operatively associated therewith to stabilize the position of the frame and frame extension C-1 during the straightening operation, as well as longitudinally adjusting the pan K so that wash water will flow forwardly therein to the drain opening. A pair of vertically adjustable legs 66 are secured to the forward portion of frame C as shown in FIG. 1 that cooperate with the jacks to attain the above result. The arrows 70 and 72 shown in FIG. 8 extend upwardly from ground surface 74 to visually indicate that when the apparatus is in an operating condition the rearward end of vehicle B is substantially higher than the forward end to assure that wash water will flow forwardly to drain opening 24.

The use and operation of the invention has been described previously in detail and need not be repeated.

What is claimed is:

1. A cooling and wash water conserving elongate tubular metal member straightening apparatus that includes:

a. an elongate rigid wheel supported, movable frame that includes a pair of parallel, laterally spaced side pieces and a forward cross piece, said frame having such weight distribution that extends to pivot downwardly and forwardly;

b. a frame extension that includes a pair of parallel, laterally spaced side piece extensions that have the major portions thereof situated rearwardly of said pair of side pieces, and a rearward cross piece secured to said pair of side piece extensions, said pair of side pieces having rearward ends and said pair of side piece extensions having forward ends;

c. a transverse shaft that extends through openings in said pair of side pieces and said pair of side pieces and side piece extensions adjacent said rearward and forward ends thereof for pivotally supporting said frame extension in a cantilevered position rearwardly from said frame;

d. forward and rearward rigid sheets situated below said frame and frame extension and secured thereto to cooperate therewith to define an elongate pan and pan extension, said forward and rearward sheets having adjacent transverse edges;

e. first means on said forward ends, rearward ends, and adjacent transverse edges for effecting a seal between said pan and pan extension when said pan extension is pivoted into substantially longitudinal alignment with said pan;

f. second means for adjusting said pan to a desired downwardly and forwardly extending position, said forward sheet having a water discharge opening therein adjacent said forward cross piece;

g. forward and rearward sprockets rotatably supported above said pan and pan extension adjacent said forward and rearward cross pieces;

h. an endless chain belt that engages said first and second sprockets and extends under said shaft, said chain belt including an upper reach;

i. a pump that includes a discharge outlet and an inlet in communication with said opening;

j. a carriage assembly longitudinally movable on said pair of side pieces and side piece extensions when the latter are longitudinally aligned with said pair of side pieces, said carriage assembly secured to said upper reach of said chain belt, with said carriage assembly including third means for sequentially subjecting longitudinal sections of an elongate tubular metal member to a transverse force when said elongate tubular metal member is longitudinally disposed above said frame and frame extension, said elongate metal member having forward and rearward ends;

k. rotatable water conducting coupling means adjacent said forward cross piece that removably engage said forward end of an elongate tubular metal member when the latter is disposed on said frame and frame extension;

l. power means for selectively rotating said coupling and an elongate tubular metal member in engagement therewith, longitudinally moving said carriage on said frame and frame extension relative to an elongate metal member to straighten the same, and drive said pump to discharge water through said coupling into said elongate tubular metal member to cool the same, with said water discharging through said rearward end thereof and thereafter flowing forwardly by gravity in said pan extension and pan to said discharge opening to be recirculated by said pump through an elongate tubular metal member in engagement with said coupling, with said frame extension, said second sprocket, and a portion of said chain belt rearwardly of said shaft when said straightening apparatus is not in use capable of being pivoted to an upwardly and forwardly extending position above said frame; and m. fourth means for removably maintaining said frame extension above said frame.

2. An apparatus as defined in claim 1 in which said first means are:

m. forward and rearward generally U-shaped plates secured to said rearward ends of said pair of cross pieces and said forward sheet and said forward ends of said cross piece extensions and rearward sheet; and n. a resilient generally U-shaped pad secured to one of said generally U-shaped plates, said pad being compressed between said forward and rearward U-shaped plates into sealing engagement therewith due to the weight of said frame extension as the latter tends to pivot downwardly relative to said frame, and said forward and rearward plates and said pad cooperating to act as stops to prevent said frame extension pivoting downwardly below a longitudinally aligned position with said frame.

3. An apparatus as defined in claim 1 in which said second means are a pair of jacks operatively associated with said frame and disposed adjacent said forward cross piece.

4. An apparatus as defined in claim 1 in which said fourth means is an elongate transversely deformable members that is secured to said rearward cross piece and may be removably secured to said carriage to pivot said frame extension to said upwardly and forwardly extending position.

5. An apparatus as defined in claim 1 which in addition includes:

n. a screen that extends transversely across said pan rearwardly of said discharge opening to prevent solid material displaced from an elongate tubular member as the latter is straightened entering said discharge opening to clog the latter.

* * * * *